US011326605B2

(12) United States Patent
Lee

(10) Patent No.: US 11,326,605 B2
(45) Date of Patent: May 10, 2022

(54) DUAL CYLINDER ROTARY COMPRESSOR WITH INTERMEDIATE PLATE THAT FLOWS BOTH CYLINDERS TO THE MUFFLER

(71) Applicant: LG Electronics Inc., Seoul (KR)

(72) Inventor: Seungmock Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 274 days.

(21) Appl. No.: 16/176,111

(22) Filed: Oct. 31, 2018

(65) Prior Publication Data

US 2019/0195228 A1 Jun. 27, 2019

(30) Foreign Application Priority Data

Dec. 22, 2017 (KR) ..... 10-2017-0178761

(51) Int. Cl.
*F04C 29/06* (2006.01)
*F04C 23/00* (2006.01)
*F04C 18/356* (2006.01)

(52) U.S. Cl.
CPC ..... *F04C 29/065* (2013.01); *F04C 18/3564* (2013.01); *F04C 23/001* (2013.01); *F04C 23/008* (2013.01); *F04C 29/06* (2013.01)

(58) Field of Classification Search
CPC .. F04C 18/3564; F04C 23/001; F04C 23/008; F04C 29/06; F04C 29/065
See application file for complete search history.

(56) References Cited

U.S. PATENT DOCUMENTS

2014/0250937 A1 9/2014 Hirayama

FOREIGN PATENT DOCUMENTS

| | | |
|---|---|---|
| CN | 1749569 | 3/2006 |
| CN | 103827500 | 5/2014 |
| CN | 106089655 | 11/2016 |

(Continued)

OTHER PUBLICATIONS

Machine Translation of JP 10-213087, Inventor Ozu, Patent Publication Nov. 8, 1998, Title: Rotary Compressor. (Year: 1998).*

(Continued)

*Primary Examiner* — Mary Davis
(74) *Attorney, Agent, or Firm* — Birch, Stewart, Kolasch & Birch, LLP

(57) ABSTRACT

A rotary compressor includes: a shell forming an internal space; a driving motor disposed in the internal space of the shell; a rotary shaft connected to the driving motor; a lower cylinder having a lower chamber for compressing a refrigerant and a lower roller disposed inside the lower chamber; an upper cylinder disposed on an upper side of the lower cylinder and having an upper chamber for compressing a refrigerant and an upper roller disposed inside the upper chamber; a muffler disposed on the upper side of the upper cylinder and receiving a refrigerant compressed in the upper chamber; and an intermediate plate disposed between the upper cylinder and the lower cylinder and having a rotary shaft hole through which the rotary shaft is disposed. The intermediate plate includes an opening formed around the rotary shaft hole and guiding a refrigerant compressed in the lower chamber to the muffler.

16 Claims, 7 Drawing Sheets

(56) References Cited

FOREIGN PATENT DOCUMENTS

| | | |
|---|---|---|
| JP | H08-219069 | 8/1996 |
| JP | H10-213087 | 11/1998 |
| JP | 2015-169142 | 9/2015 |
| KR | 10-0408246 | 12/2003 |
| KR | 10-2006-0120382 | 11/2006 |
| KR | 10-2007-0000541 | 1/2007 |
| KR | 10-1075767 | 10/2011 |
| KR | 10-2009-0125645 | 11/2014 |

OTHER PUBLICATIONS

CN Office Action dated Dec. 11, 2019.
European Search Report dated Feb. 4, 2019.

* cited by examiner

DUAL CYLINDER ROTARY COMPRESSOR WITH INTERMEDIATE PLATE THAT FLOWS BOTH CYLINDERS TO THE MUFFLER

CROSS-REFERENCE TO RELATED APPLICATIONS

The present application claims priority under 35 U.S.C. 119 and 35 U.S.C. 365 to Korean Patent Application No. 10-2017-0178761 (filed on Dec. 22, 2017), which is hereby incorporated by reference in its entirety.

BACKGROUND OF THE INVENTION

Field of the Invention

The present invention relates to a rotary compressor that can minimize a loss of pressure of a refrigerant compressed by a lower cylinder and can reduce vibration noise when the compressed refrigerant is discharged.

Description of the Related Art

In general, a compressor, which is a mechanical apparatus that increases the pressure of air, a refrigerant, or other various working gases by compressing them using power from a power generator such as an electric motor or a turbine, is generally used for home appliances, such as a refrigerator and an air conditioner, or throughout industry.

Compressors can be classified in a broad sense into a reciprocating compressor, a rotary compressor, and a scroll compressor.

As for the reciprocating compressor, a compression space into or from which a working gas is suctioned or discharged is formed between a piston and a cylinder and the piston compresses the refrigerant by reciprocating straight in the cylinder.

As for the rotary compressor, a compression space into or from which a working gas is suctioned or discharged is formed between a roller that eccentrically rotates and a cylinder and the roller compresses the working gas by eccentrically rotating on the inner side of the cylinder.

As for the scroll compressor, a compression space into or from which a working gas is suctioned or discharged is formed between an orbiting scroll and a fixed scroll and the orbiting scroll compresses a refrigerant by rotating on the fixed scroll.

A variable displacement compressor has been disclosed in Korean Patent Application Publication No. 10-2009-0125645 (published on Dec. 7, 2009) that is a prior art document.

The variable displacement compressor disclosed in the prior art document includes a sealed container, a lower compression assembly, an intermediate plate, an upper compression assembly, an upper muffler, a lower muffler, and a motor.

The upper muffler, the upper compression assembly, the intermediate plate, the lower compression assembly, and the lower muffler are sequentially arranged under the motor.

The upper compression assembly includes an upper cylinder, an upper eccentric member, and upper vanes disposed in the upper cylinder.

The lower compression assembly includes a lower cylinder, a lower eccentric member, and lower vanes disposed in the lower cylinder.

The upper eccentric member and the lower eccentric member are connected to a rotary shaft and the rotary shaft is connected to the motor.

When the motor is operated, the rotary shaft is rotated and a refrigerant is compressed in the upper compression assembly and the lower compression assembly. The refrigerant compressed in the upper compression assembly is discharged to the upper muffler and the refrigerant compressed in the lower compression assembly is discharged to the lower muffler.

The refrigerant discharged to the lower muffler flows to the upper muffler through the upper compression assembly, the intermediate plate, and an opening of the lower compression assembly.

However, the refrigerant compressed in the lower compression assembly flows through the lower muffler, the lower compression assembly, the intermediate plate, and the upper compression assembly and then reaches the upper muffler. Accordingly, the distance that the compressed refrigerant flows is long, so the pressure of the refrigerant is reduced.

Further, noise that is generated in the process of discharging the compressed refrigerant from the upper compression assembly to the upper muffler and noise that is generated in the process of discharging the compressed refrigerant from the lower compression assembly to the lower muffler overlap each other.

SUMMARY OF THE INVENTION

An object of the present invention is to provide a rotary compressor that can prevent a loss of pressure of a compressed refrigerant in a lower compression assembly.

Another object of the present invention is to provide a rotary compressor that can reduce noise that is generated while a compressed air is discharged from a lower compression assembly and an upper compression assembly.

According to a rotary compressor of the present invention, an opening through which a refrigerant compressed in a lower cylinder can pass is formed in an intermediate plate disposed between an upper cylinder in which a refrigerant is compressed by an upper roller and the lower cylinder in which a refrigerant is compressed by a lower roller, so the refrigerant compressed in the lower cylinder can pass through the intermediate plate.

Further, according to the rotary compressor of the present invention, a refrigerant compressed in the lower cylinder can flow into a muffler into which the refrigerant compressed in the upper cylinder flows, through the opening of the intermediate plate, so the channel for a refrigerant from the lower cylinder to the muffler can be reduced.

Further, according to the rotary compressor of the present invention, the refrigerant compressed in the lower cylinder can flow into the muffler into which the refrigerant compressed in the upper cylinder flows, so the structure of the rotary compressor can be simplified.

Further, according to the rotary compressor of the present invention, it is possible to prevent interactive amplification of noise that is generated while the refrigerant compressed in the upper cylinder is discharged and noise that is generated while the refrigerant compressed in the lower cylinder is discharged.

Further, according to the rotary compressor of the present invention, the intermediate plate is formed by combining a first intermediate plate and a second intermediate plate, so the manufacturing process, assembly process, and durability of the intermediate plate can be improved.

According to the present invention, since the refrigerant compressed in the lower cylinder quickly flows into the muffler through the opening of the intermediate plate and the distance from the lower cylinder to the muffler is reduced, it is possible to prevent a loss of pressure of the refrigerant compressed in the lower cylinder.

Further, since the refrigerant compressed in the lower cylinder and the refrigerant compressed in the upper cylinder are received in one muffler, it is possible to simplify the structure and increase the amount of the refrigerant that can be kept in a shell, as compared with respectively installing mufflers for the cylinders.

Further, since the rotary compressor is configured such that an exciting force that is generated while the refrigerant compressed in the lower cylinder is discharged and an exciting force that is generated while the refrigerant compressed in the upper cylinder are applied in the same direction, the noise that is generated while a refrigerant is discharged from the upper cylinder and the noise that is generated while a refrigerant is discharged from the lower cylinder are offset, so compression noise can be reduced.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
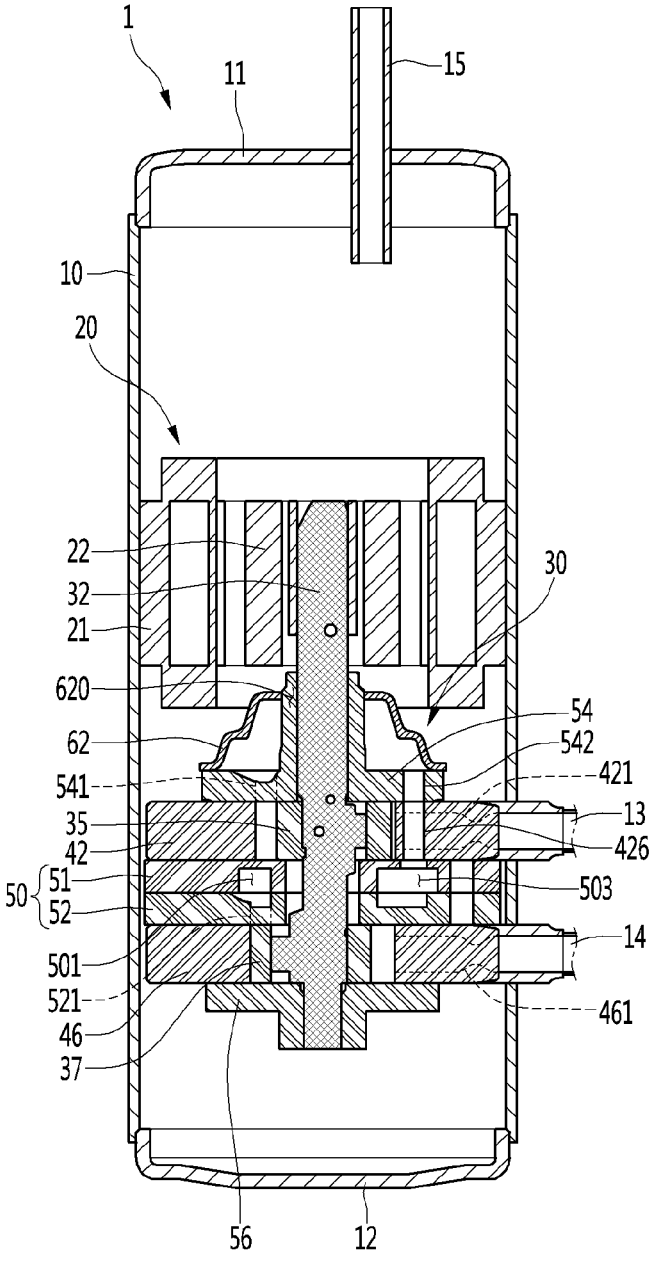
FIG. 1 is a cross-sectional view showing the configuration of a rotary compressor according to a first embodiment of the present invention.
Figure 2:
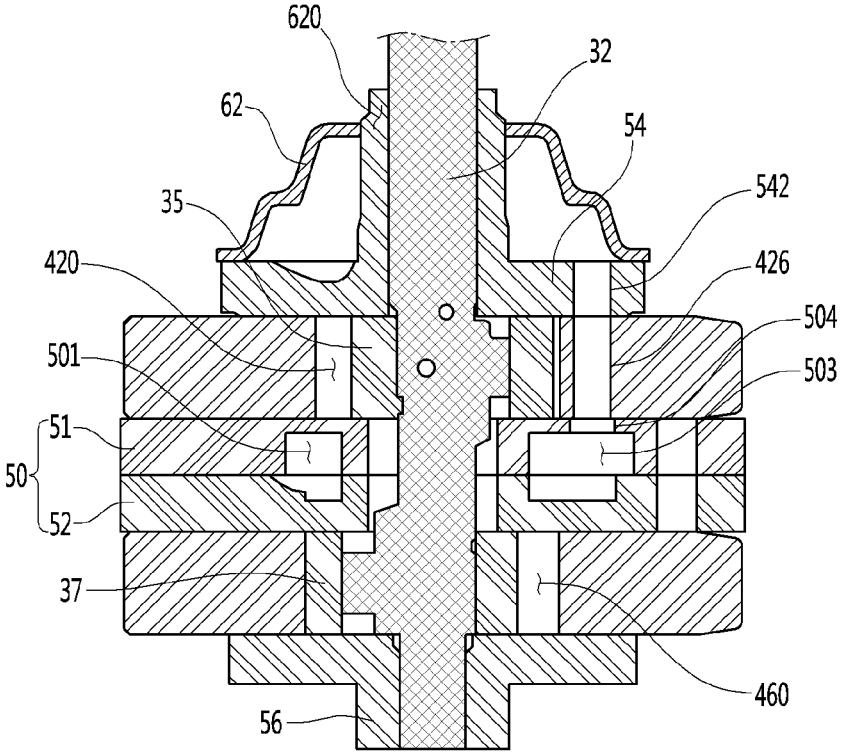
FIG. 2 is a cross-sectional view of a compression assembly according to the first embodiment of the present invention.
Figure 3:
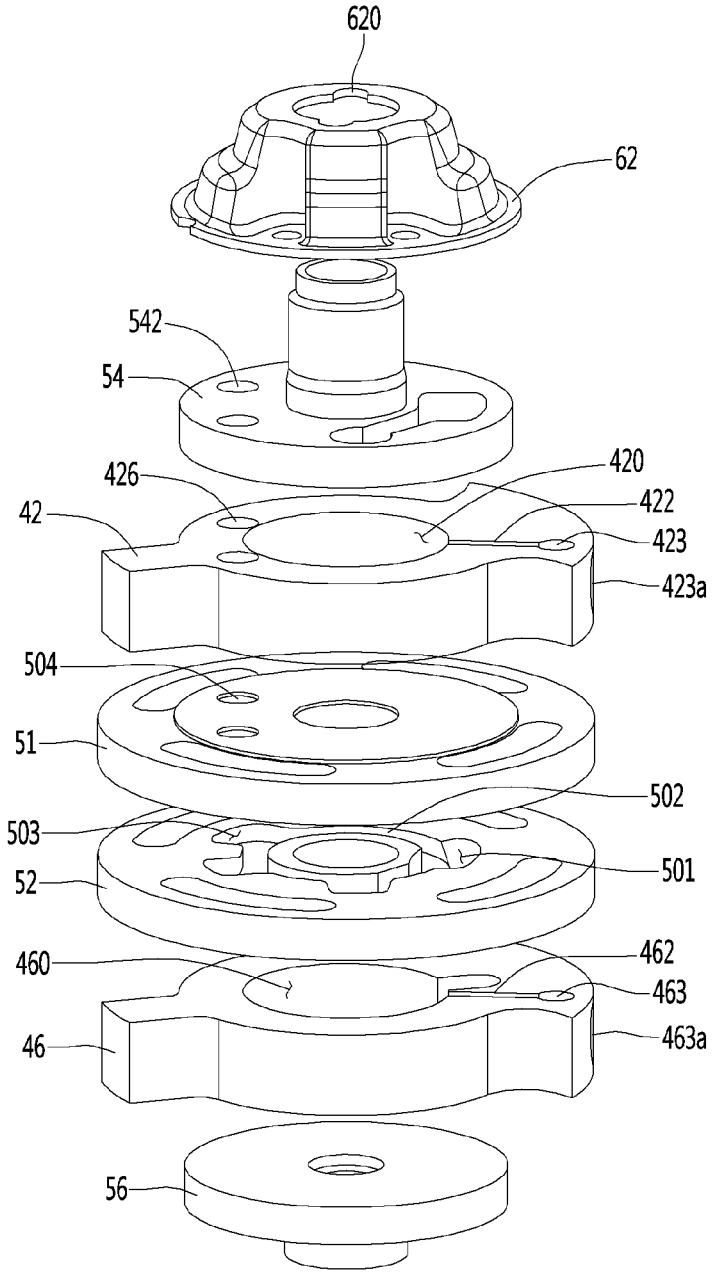
FIG. 3 is an exploded perspective view of the compression assembly according to the first embodiment of the present invention.

FIG. 1 is a cross-sectional view showing the configuration of a rotary compressor according to a first embodiment of the present invention, FIG. 2 is a cross-sectional view of a compression assembly according to the first embodiment of the present invention, and FIG. 3 is an exploded perspective view of the compression assembly according to the first embodiment of the present invention.

Referring to FIGS. 1 to 3, a rotary compressor 1 according to a first embodiment of the present invention may include a shell 10 forming an internal space, a top cap 11 coupled to the top of the shell 10, and a bottom cap 12 coupled to the bottom of the shell 10.

The shell 10, for example, may be formed in a cylindrical shape. The shell 10 may have a top opening and a bottom opening.

A portion of the top cap 11 may be formed in a cylindrical shape and may be inserted in the shell 10 through the top opening of the shell 10.

A portion of the bottom cap 12 may be formed in a cylindrical shape and may be inserted in the shell 10 through the bottom opening of the shell 10.

Alternatively, the shell 10 is open at the top or the bottom, but one of them may be closed. In this case, the opening of the shell 10 can be covered by a single cap.

A plurality of suction pipes 13 and 14 may be connected to the shell 10 and an exhaust pipe 15 may be connected to the top cap 11. The suction pipes 13 and 14 may include a first suction pipe 13 connected to an upper compression unit to be described below and a second suction pipe 14 connected to a lower compression unit to be described below.

The rotary compressor 1 may further include a driving motor 20 disposed in the shell 10 and a compression assembly 30 connected to the driving motor 20 to compress a refrigerant.

The driving motor 20 may include a stator 21 that generates a magnetic force when it is powered and a rotor 22 disposed inside the stator 21.

The stator 21 may be fixed to the inner side of the shell 10. However, the stator 21 may be spaced apart from the inner side of the shell 10 so that oil can move up and down through the stator 21 in the shell 10.

The rotor 22 can be rotated inside the stator 21 by induced electromotive force that is generated by interaction with the stator 21.

The compression assembly 30 can compress a refrigerant using torque from the rotor 22. The compression assembly 30 may be configured to compress a refrigerant in a single chamber or in a plurality of chambers.

It is exemplified in FIG. 1 that the compression assembly 30 can perform compression in two chambers.

The compression assembly 30 may include a rotary shaft 32 connected to the rotor 22 to transmit torque.

The rotary shaft 32 may vertically extend in the shell 10. An oil channel (not shown) for flow of oil may be formed in the rotary shaft 32. The oil channel (not shown) may be formed vertically through the rotary shaft 32. A divergent channel for supplying oil to chambers of cylinders to be described below may diverge from the oil channel (not shown).

The compression assembly 30 may include an upper compression unit and a lower compression unit.

The upper compression unit and the lower compression unit may be connected to the rotary shaft 32.

The upper compression unit may include an upper cylinder 42 forming an upper chamber 420 and an upper roller 35 coupled to the rotary shaft 32 in the upper chamber 420. The upper cylinder is disposed on the upper side of the lower compression unit and includes the upper chamber 420 for compressing a refrigerant and the upper roller disposed inside the upper chamber 420.

The upper roller 35 is eccentrically coupled to the rotary shaft 32, so it can be rotated on a predetermined eccentric orbit by rotation of the rotary shaft 32.

The upper cylinder 42 may have a first vane slot 422 and an upper vane (not shown) may be accommodated in the first vane slot 422.

A first spring slot 423*a* in which an upper spring (not shown) is accommodated may be formed at an end of the first vane slot 422. The first spring slot 423*a* may extend toward the first vane slot 422 on the side of the upper cylinder 42.

The upper cylinder 42 may have a first oil supply slot 423 for flow of oil. The first oil supply slot 423 may be vertically formed through the upper cylinder 42.

The diameter of the first oil supply slot 423 may be larger than the width of the first vane slot 422 so that oil can smoothly flow into the first oil supply slot 423.

The first vane slot 422 may partially move to the first oil supply slot 423 when it reciprocates.

The first oil supply slot 423 may be formed vertically through the first spring slot 423*a*. Accordingly, the first spring slot 423*a* and the first oil supply slot 423 can cross each other.

The first oil supply slot 423 may communicate with the first vane slot 422. Accordingly, the oil flowing in the first oil supply slot 423 can be supplied to the first vane slot 422.

The upper vane (not shown) divides the upper chamber 420 into a suction chamber and a compression chamber by reciprocating in the first vane slot 422.

An upper refrigerant inlet 421 through which a refrigerant flows inside is formed in the upper cylinder 42.

The upper refrigerant inlet 421, which is a passage through which a refrigerant flowing inside through the first suction pipe 13 flows to the upper chamber 420, can connect the first suction pipe 13 and the upper chamber 420 to each other.

The upper cylinder 42 may further have an upper refrigerant outlet (not shown) through which a compressed refrigerant is discharged.

The upper compression unit may further include a main bearing 54 disposed on the upper of the upper cylinder 42.

The main bearing 54 is fixed to the inner side of the shell 10 and covers the top of the upper chamber 420. The main bearing 54 may be disposed under the driving motor 20.

The rotary shaft 32 is connected to the rotor 22 through the main bearing 54. The main bearing 54 guides the rotary shaft 32 such that the rotary shaft 32 stably rotates without eccentricity.

An upper exhaust port 541 that communicates with an upper refrigerant outlet may be formed in the main bearing 54. The upper exhaust port 541 can be opened/closed by an upper exhaust valve (not shown).

An upper muffler 62 may be disposed on the upper side of the main bearing 54. The upper muffler 62 receiving a refrigerant compressed in the upper chamber 420.

The upper muffler 62 can reduce noise that is generated when a refrigerant compressed in the upper cylinder 42 is discharged. The upper muffler 62 can reduce noise that is generated when a refrigerant compressed in the lower cylinder 46 to be described below is discharged.

The rotary shaft 32 may be disposed through the upper muffler 62. One or more through-holes 620 for passing a refrigerant may be formed in the upper muffler 62. The through-holes 620 may be formed in a hole of the upper muffler 62 where the rotary shaft 32 passing through the upper muffler 62 is positioned. In the embodiment, the through-holes 620 may be positioned between the rotary shaft 32 and the upper muffler 62 and a refrigerant can flow between the rotary shaft 32 and the upper muffler 62.

The lower compression unit may include a lower cylinder 46 forming a lower chamber 460 and a lower roller 37 coupled to the rotary shaft 32 in the lower chamber 460. The lower cylinder 46 having the lower chamber 460 for compressing a refrigerant and the lower roller 37 disposed inside the lower chamber 460.

The lower roller 37 is eccentrically coupled to the rotary shaft 32, so it can be rotated on a predetermined eccentric orbit by rotation of the rotary shaft 32.

The lower cylinder 46 may have a second vane slot 462 and a lower vane may be inserted in the second vane slot 462.

A second spring slot 463*a* in which a lower spring (not shown) is accommodated may be formed at an end of the second vane slot 462. The second spring slot 463*a* may extend toward the second vane slot 462 on the side of the lower cylinder 46.

The lower cylinder 46 may have a second oil supply slot 463 for flow of oil. The second oil supply slot 463 may be vertically formed through the lower cylinder 46.

The second oil supply slot 463 may be formed vertically through the second spring slot 463*a*. Accordingly, the second spring slot 463*a* and the second oil supply slot 463 may cross each other.

The second oil supply slot 463 may communicate with the second vane slot 462. Accordingly, the oil flowing in the second oil supply slot 463 can be supplied to the first vane slot 462.

The lower vane (not shown) divides the lower chamber 460 into a suction chamber and a compression chamber by reciprocating in the second vane slot 462.

A lower refrigerant inlet 461 through which a refrigerant flows inside is formed in the lower cylinder 46.

The lower refrigerant inlet 461, which is a passage through which a refrigerant flowing inside through the second suction pipe 14 flows to the lower chamber 460, can connect the second suction pipe 14 and the lower chamber 460 to each other.

The lower cylinder 46 may further have a lower refrigerant outlet (not shown) through which a compressed refrigerant is discharged.

The lower compression unit may further include a sub bearing 56 disposed under the lower cylinder 46.

The sub bearing 56 can support the lower cylinder 46. The sub bearing 56 can cover the bottom of the lower chamber 460.

The rotary shaft 32 may be disposed through the sub bearing 56. Accordingly, the sub bearing 56 guides the rotary shaft 32 such that the rotary shaft 32 stably rotates without eccentricity.

The compression assembly 30 may further include an intermediate plate 50 disposed between the upper cylinder 42 and the lower cylinder 46.

The intermediate plate 50 can cover the bottom of the upper chamber 420 and the top of the lower chamber 460. The intermediate plate 50 prevents direct friction between the upper roller 35 and the lower roller 37 when the rotary shaft 32 rotates. The rotary shaft 32 may be disposed through the intermediate plate 50.

The intermediate plate 50 may include a first intermediate plate 51 covering the bottom of the upper chamber 420 and a second intermediate plate 52 covering the top of the lower chamber 460.

The first intermediate plate 51 may be disposed on the second intermediate plate 52 and the second intermediate plate 52 may be disposed under the first intermediate plate 51. The bottom of the first intermediate plate 51 and the top of the second intermediate plate 52 may be in contact with each other.

The refrigerant compressed in the lower chamber 460 flows into the upper muffler 62 through the intermediate plate 50, the upper cylinder 42, and the main bearing 54. To this end, openings 501, 503, 504, 426, and 542 for passing a refrigerant may be formed in the intermediate plate 50, the upper cylinder 42, and the main bearing 54.

The openings 501, 503, 504, 426, and 542 may include a first opening 501, a second opening 503, and a third opening 504 that are formed in the intermediate plate 50, a fourth opening 426 that is formed in the upper cylinder 42, and a fifth opening 542 that is formed in the main bearing 54. The first to fifth openings may communicate with one another.

The first opening 501 and the second opening 503 may be formed by recessing a portion of the bottom of the first intermediate plate 51 and a portion of the top of the second intermediate plate 52.

For example, portions of the first opening 501 and the second opening 503 may be recessed upward on the bottom of the first intermediate plate 51. Further, the other portions of the first opening 501 and the second opening 503 may be recessed downward on the top of the second intermediate plate 52.

That is, the first opening 501 and the second opening 503 may be formed between the first intermediate plate 51 and the second intermediate plate 52, whereby the first and second openings can be positioned inside the intermediate plate 50.

A lower exhaust port 521 through which the refrigerant compressed in the lower chamber 460 can flow into the first opening 501 may be formed in the second intermediate plate 52. The lower exhaust port 521 supplies the refrigerant compressed in the lower chamber 460 into the intermediate plate 50. The lower exhaust port 521 can be opened/closed by a lower exhaust valve (not shown). The lower exhaust port 521 and the lower exhaust valve (not shown) may be disposed in the first opening 501.

The refrigerant compressed in the lower chamber 460 can flow into the first opening 501 through the lower exhaust port 521 and can be discharged to the upper muffler 62 through the first to fifth openings.

On the other hand, when the rotary compressor 1 is operated and the rotary shaft 32 is rotated, oil is supplied to the upper chamber 420 and the lower chamber 460, thereby lubricating the friction surfaces of the rollers 35 and 37.

In general, oil should be supplied such that at least the upper cylinder 42 of the compression assembly 30 is submerged under the oil in the shell 10.

This is because oil should be supplied to the first oil supply slot 423 of the upper cylinder 42. Accordingly, the level of oil in the shell 10 can be maintained higher than the height of the upper cylinder 42.

Figure 4:
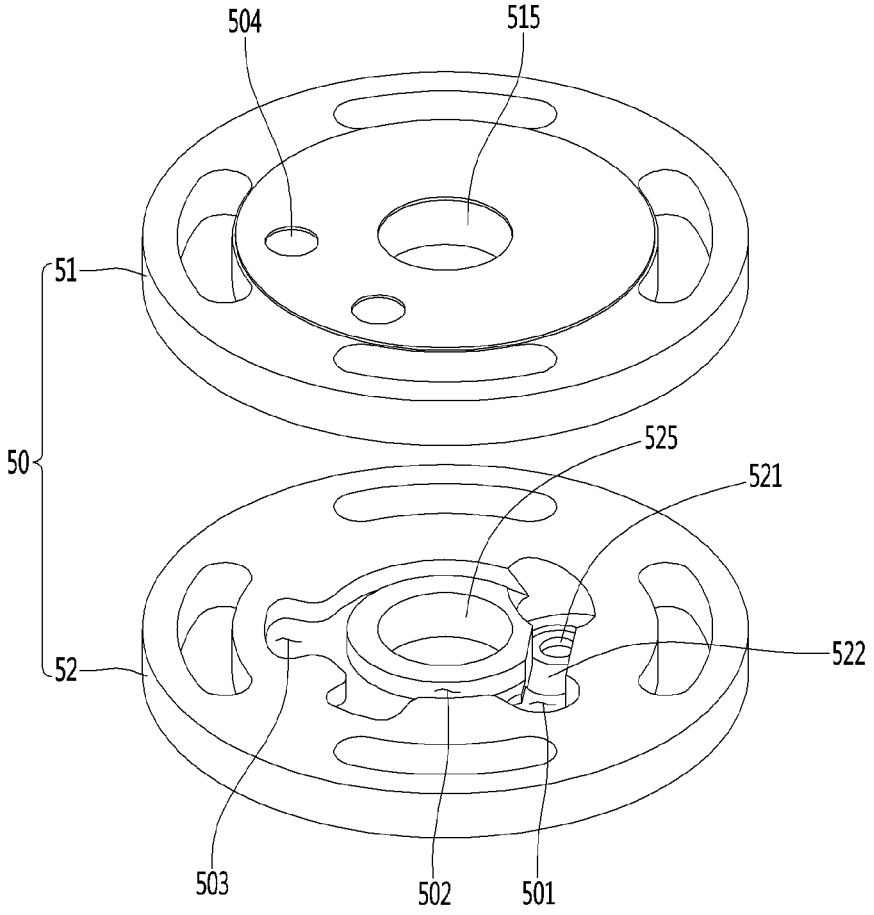
FIG. 4 is an exploded perspective view of an intermediate plate according to the first embodiment of the present invention.

FIG. 4 is an exploded perspective view of an intermediate plate according to the first embodiment of the present invention.

Referring to FIG. 4, the intermediate plate 50 may include the first intermediate plate 51 disposed at an upper portion and the second intermediate plate 52 disposed under the first intermediate plate 51. The bottom of the first intermediate plate 51 and the top of the second intermediate plate 52 may be in contact with each other.

The intermediate plate 50 may be disposed between the upper cylinder 42 and the lower cylinder 46 such that the refrigerant compressed in the lower chamber 460 of the lower cylinder 46 can flow to the upper muffler 62.

To this end, the first opening 501, second opening 503, and third opening 504 may be formed in the intermediate plate 50. The first opening 501, second opening 503, and third opening 504 communicate with one another and the refrigerant compressed in the lower chamber 460 can flow to the upper muffler 62 through the intermediate plate 50.

In detail, the third opening 504 through which the refrigerant flowing into the intermediate plate 50 through the lower exhaust port 521 to be described below is discharged out of the intermediate plate 50 may be formed in the first intermediate plate 51. One or more third openings 504 may be formed.

The lower exhaust port 521 through which the refrigerant compressed in the lower cylinder 46 passes may be formed in the second intermediate plate 52. The lower exhaust port 521 can be opened/closed by the lower exhaust valve (not shown). A lower valve seat 522 in which the lower exhaust valve (not shown) is installed may be formed on the second intermediate plate 52. The lower valve seat 522 may be recessed downward further than the first opening 501. The lower exhaust valve (not shown) is inserted in the lower valve seat 522 and a second end of the lower exhaust valve (not shown) can open/close the lower exhaust port 521 with a first end of the lower exhaust valve (not shown) fixed by a fastener.

The first opening 501 and the second opening 503 through which the refrigerant flowing in the lower exhaust port 521 passes and a connection opening 502 that connects the first opening 501 and the second opening 503 to each other may be formed in the first intermediate plate 51 and the second intermediate plate 52. The refrigerant flowing into the lower exhaust port 521 can sequentially pass through the first opening 501, the connection opening 502, the second opening 503, and the third opening 504.

Portions of the first opening 501, the connection opening 502, and the second opening 503 may be recessed toward the bottom of the second intermediate plate 52 from the top of the second intermediate plate 52, that is, may be recessed downward. The other portions of the first opening 501, the connection opening 502, and the second opening 503 may be recessed toward the top of the first intermediate plate 51 from the bottom of the first intermediate plate 51, that is, may be recessed upward. The first opening 501, the connection opening 502, and the second opening 503 may be arranged at positions corresponding to one another on the bottom of the first intermediate plate 51 and the top of the second intermediate plate 52.

That is, a portion of the bottom of the first intermediate plate 51 and a portion of the top of the second intermediate plate 52 are recessed and connected to each other, whereby a channel through which a refrigerant passes can be formed.

The refrigerant flowing into the intermediate plate 50 through the lower exhaust port 521 can sequentially flow through the first opening 501, the connection opening 502, and the second opening 503 and can be discharged out of the intermediate plate 50 through the third opening 504.

The first opening 501 and the second opening 503 may be spaced apart from each other radially from the center of the intermediate plate 50. The first opening 501 and the second opening 503 may be arranged to face each other. For example, the first opening 501 may be disposed eccentrically at a side from the center of the intermediate plate 50 and the second opening 503 may be disposed eccentrically at the other side from the center of the intermediate plate 50. The first opening 501 and the second opening 503 that are spaced apart from each other can be connected to each other through the connection opening 502.

One or more third openings 504 may be provided. The second opening 503 may be provided in the number corresponding to the third opening 504. For example, when a plurality of third openings 504 is provided, the second opening 503 may be provided in the number corresponding to the third openings 504 under the third openings 504. The second openings 503, the third openings 504, and the first opening 501 may be connected to one another through the connection opening 502.

A first rotary shaft hole 515 and a second rotary shaft hole 525 through which the rotary shaft 32 passes may be formed in the first intermediate plate 51 and the second intermediate plate 52, respectively. The first rotary shaft hole 515 and the second rotary shaft hole 525 may communicate with each other. This is, the intermediate plate 50 having a rotary shaft hole 515, 525 through which the rotary shaft 32 is disposed. The first rotary shaft hole 515 and the second rotary shaft hole 525 may be positioned at the center of the intermediate plate 50. The rotary shaft hole 515 and the second rotary shaft hole 525 may be separated from the first opening 501, the second opening 503, and the connection opening 502.

The first opening 501 may be positioned at a side of the rotary shaft holes 515 and 525. The second opening 503 may be positioned at the other side of the rotary shaft holes 515 and 525. The connection opening 502 may be elongated along portions of the outer sides of the rotary shaft holes 515 and 525 and can connect the first opening 501 and the second opening 503 to each other. That is, when the refrigerant flowing in the first opening 501 flows through the connection opening 502, it can flow along portions of the outer sides of the rotary shaft holes 515 and 525 and can be discharged out of the intermediate plate 50 through the third opening 504 from the second opening 503.

Alternatively, the first opening 501, the second opening 503, and the connection opening 502 may be recessed in the radial direction of the intermediate plate 50 around the rotary shaft holes 515 and 525. The first opening 501 and the second opening 503 may be recessed further than the connection opening 502. Since the first opening 501 and the second opening 503 are further recessed in the radial direction of the intermediate plate 50, the amount of a refrigerant that can pass through the first opening 501 and the second opening 503 can be increased. Further, since the lower exhaust port 521 and the lower exhaust valve (not shown) should be installed at the first opening 501, the first opening 501 may be recessed further than the connection opening 502. Further, the second opening 503 may be further recessed in the radial direction of the intermediate plate 50 to reduce noise of the refrigerant discharged to the third opening 503 and to secure a channel. The third opening 504 may be disposed inside the second opening 503 recessed in the radial direction of the intermediate plate 50.

At least one or more connection openings 502 may be provided around the rotary shaft holes 515 and 525 to connect the first opening 501 and the second opening 503 to each other. A plurality of connection openings 502 is provided at a side and the other side of the rotary shaft holes 515 and 525 in the embodiment. Namely, the openings 501, 503, 504, 426, and 542 guiding a refrigerant compressed in the lower chamber 460 to the muffler 62.

According to the present invention, since the refrigerant compressed in the lower chamber 460 of the lower cylinder 46 can flow to the upper muffler 62 through the intermediate plate 50, the distance that the compressed refrigerant flows is reduced, so a compression loss of a refrigerant can be minimized.

A process of compressing a refrigerant by means of the compression assembly is described hereafter.

Figure 5:
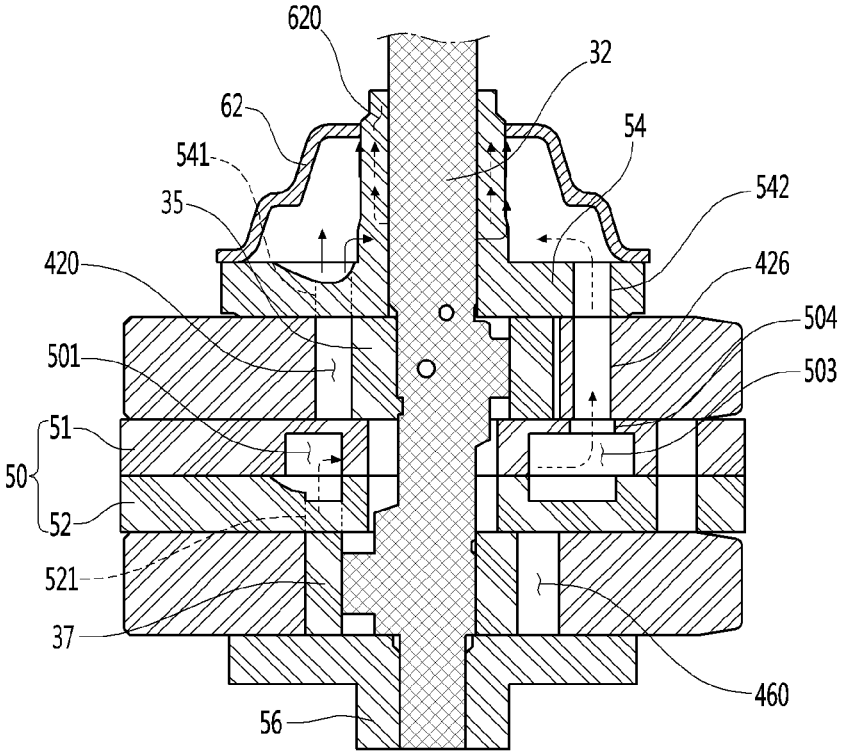
FIG. 5 is a view showing flow of a compressed refrigerant in an upper cylinder and a lower cylinder according to the first embodiment of the present invention.

FIG. 5 is a view showing flow of a compressed refrigerant in an upper cylinder and a lower cylinder according to the first embodiment of the present invention.

Referring to FIG. 5, when power is applied to the stator 21 of the driving motor 20, the rotor 22 can be rotated. When the rotor 22 is rotated, the rotary shaft 32 can be rotated with the rotor 22.

When the rotary shaft 32 is rotated, the upper roller 35 can be eccentrically rotated in the upper cylinder 42 and the lower roller 37 can be eccentrically rotated in the lower cylinder 46.

A refrigerant suctioned into the shell 10 through the first suction pipe 13 can flow to the upper chamber 420 of the upper cylinder 42. A refrigerant suctioned into the shell 10 through the second suction pipe 14 can flow to the lower chamber 460 of the lower cylinder 46.

The refrigerant flowing to the upper chamber 420 can flow into the upper chamber 420 through the upper refrigerant inlet 421 of the upper cylinder 42. The refrigerant flowing to the lower chamber 460 can flow into the lower chamber 460 through the lower refrigerant inlet 461 of the lower cylinder 46.

The refrigerant flowing in the upper chamber 420 in the upper cylinder 42 can be compressed while the upper roller 35 is rotated, and then can be discharged out of the upper chamber 420 through the upper exhaust port 541.

The refrigerant discharged from the upper chamber 420 can flow into the upper muffler 62 through the upper exhaust port 541 of the main bearing 54.

The flow direction of the compressed refrigerant that flows into the upper muffler 62 from the upper chamber 420 is indicated by an arrow of a solid line.

The refrigerant flowing in the lower chamber 460 in the lower cylinder 46 can be compressed while the lower roller 37 is rotated, and then can be discharged from the lower chamber 460 through the lower exhaust port 521.

The refrigerant discharged from the lower chamber 460 can flow to the first opening 501 of the intermediate plate 50 through the lower exhaust port 521 of the intermediate plate 50.

The refrigerant flowing in the first opening 501 can sequentially pass through the second opening 503 and the third opening 504 that communicate with the first opening 501, the fourth opening 504 of the upper cylinder 42, and the fifth opening 426 of the main bearing 54. Thereafter, the refrigerant can flow into the upper muffler 62.

The flow direction of the compressed refrigerant that flows into the upper muffler 62 from the lower chamber 460 is indicated by an arrow of a dotted line.

The refrigerant flowing in the upper muffler 62 can be discharged from the upper muffler 62 through the through-hole 620 of the upper muffler 62.

The refrigerant discharged out of the upper muffler 62 can flow upward and pass through the driving motor 20 and then can be discharged out of the rotary compressor 1 through the exhaust pipe 15.

Shock vibration may be generated by pressure pulsation that is generated when a refrigerant is compressed in and discharged from the upper cylinder 42 and the lower cylinder 46 of the compression assembly 30 and the generated shock vibration can be reduced by the upper muffler 62 of the compression assembly 30.

In detail, the refrigerant compressed in the upper cylinder 42 is discharged through the upper exhaust port 541 and the upper exhaust valve (not shown) and flows into the upper muffler 62 and shock vibration generated in the upper cylinder 42 can be reduced by the upper muffler 62.

The refrigerant compressed in the lower cylinder 46 is discharged through the lower exhaust port 521 and the lower exhaust valve (not shown) and flows into the upper muffler 62 through the intermediate plate 50 and shock vibration generated in the lower cylinder 46 can be reduced by the upper muffler 62.

The compression assembly 30 according to the present invention may be configured such that exciting forces by the refrigerants compressed in the upper cylinder 42 and the lower cylinder 46 are applied in the same direction.

In detail, the upper roller 35 and the lower roller 37 are disposed to face each other on the rotary shaft 32, so the upper compression unit and the lower compression unit may have a phase difference of 180 degrees. Accordingly, the refrigerant that is compressed in the upper cylinder 42 and the refrigerant that is compressed in the lower cylinder 46 may have a phase difference of 180 degrees.

In the related art, rotary compressors are configured such that an exciting force of an upper exhaust port and an exciting force of a lower exhaust port are applied away from each other, so the exciting force of the upper exhaust port and the exciting force of the lower exhaust port consequently have the same phase, whereby shock noise is increased.

However, according to the present invention, since the rotary compressor is configured such that the exciting force of the upper exhaust port 541 and the exciting force of the lower exhaust port 521 are applied in the same direction, the exciting force of the upper exhaust port 541 and the exciting force of the lower exhaust port 521 have opposite phases and the exciting forces having opposite phases are offset, whereby an effect of reducing shock noise can be obtained.

Figure 6:
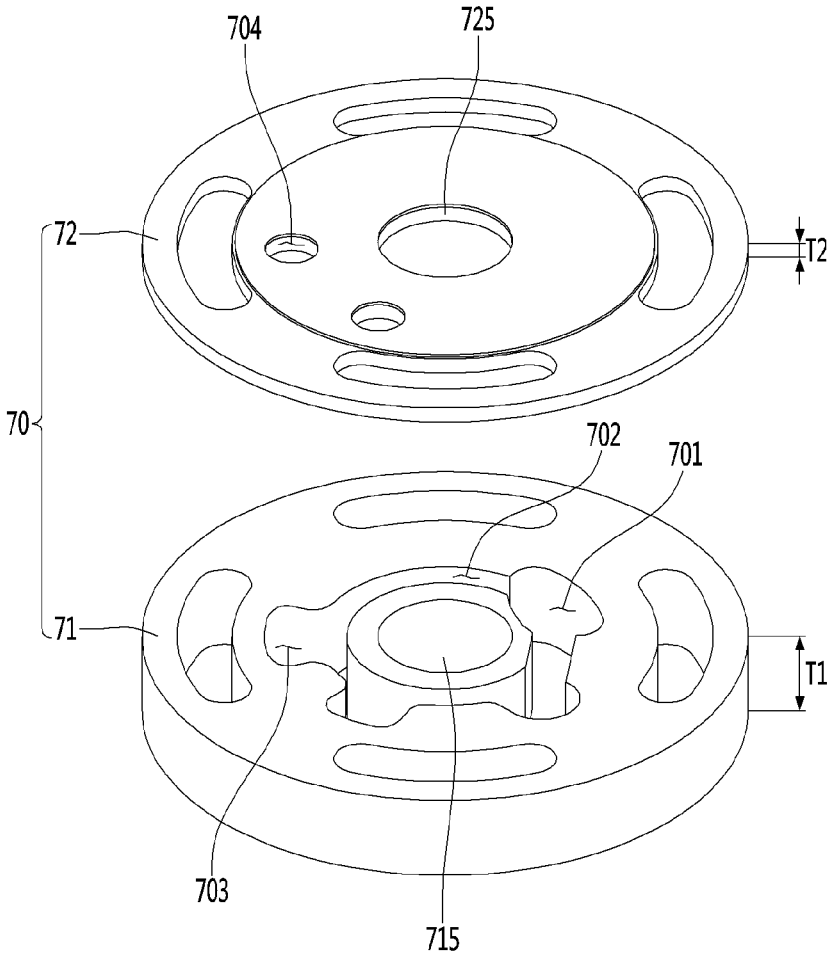
FIG. 6 is an exploded perspective view of an intermediate plate according to a second embodiment of the present invention.

FIG. 6 is an exploded perspective view of an intermediate plate according to a second embodiment of the present invention.

Referring to FIG. 6, an intermediate plate 70 according to the second embodiment of the present invention may include an intermediate plate body 71 and an intermediate plate cover 72. The intermediate plate cover 72 can be fixed to the intermediate plate body 71 while covering a portion of the intermediate plate body 71. The intermediate plate cover 72 can cover the top of the intermediate plate body 71. Rotary shaft holes 715 and 725 through which a rotary shaft can be disposed may be formed in the intermediate plate 70.

In the embodiment, the intermediate plate body 71 can be understood as the 'second intermediate plate' of the first embodiment and the intermediate plate cover 72 can be understood as the 'first intermediate plate' of the first embodiment.

The intermediate plate body 71 may have a first opening 701 and a second opening 703 through which a refrigerant compressed in the lower chamber flows into the intermediate plate body 71, and a connection opening 702 connecting the first opening 701 and the second opening 703 to each other. The intermediate plate body 71 may have a first thickness T1.

The first opening 701, second opening 703, and connection opening 702 may be recessed downward on the top of the intermediate plate body 71. The first opening 701, second opening 703, and connection opening 702 may be recessed downward on the top of the intermediate plate body 71 at a thickness smaller than the first thickness T1 of the intermediate plate body 71. That is, a space where a refrigerant can be kept can be formed in the intermediate plate body 71.

The intermediate plate body 71 may have a lower exhaust port (not shown) through which a refrigerant can flow inside from a lower chamber disposed under the intermediate plate 70 and a lower exhaust valve (not shown) opening/closing the lower exhaust port (not shown). The lower exhaust port (not shown) communicates with the first opening 701 and a refrigerant that has passed through the lower exhaust port (not shown) can flow into the first opening 701.

The intermediate plate cover 72 can cover the top of the intermediate plate body 71. The intermediate plate cover 72 may have a second thickness T2. The second thickness T2 of the intermediate plate cover 72 may be smaller than the first thickness T1 of the intermediate plate body 71. The first opening 701, second opening 703, and connection opening 702 that are recessed downward on the top of the intermediate plate body 71 can be closed by the intermediate plate cover 72.

The intermediate plate cover 72 may have a third opening 704 for discharging a refrigerant flowing in the intermediate plate body 71. The third opening 704 may be formed through a portion of the intermediate plate cover 72. The third opening 704 may be formed at a position corresponding to the second opening 703.

That is, according to the second embodiment of the present invention, it is possible to simplify the process of manufacturing the intermediate plate 70 by forming the first opening 701, second opening 703, and connection opening 702 in the intermediate plate body 71 and then covering the intermediate plate body 71 with the intermediate plate cover 72.

Figure 7:
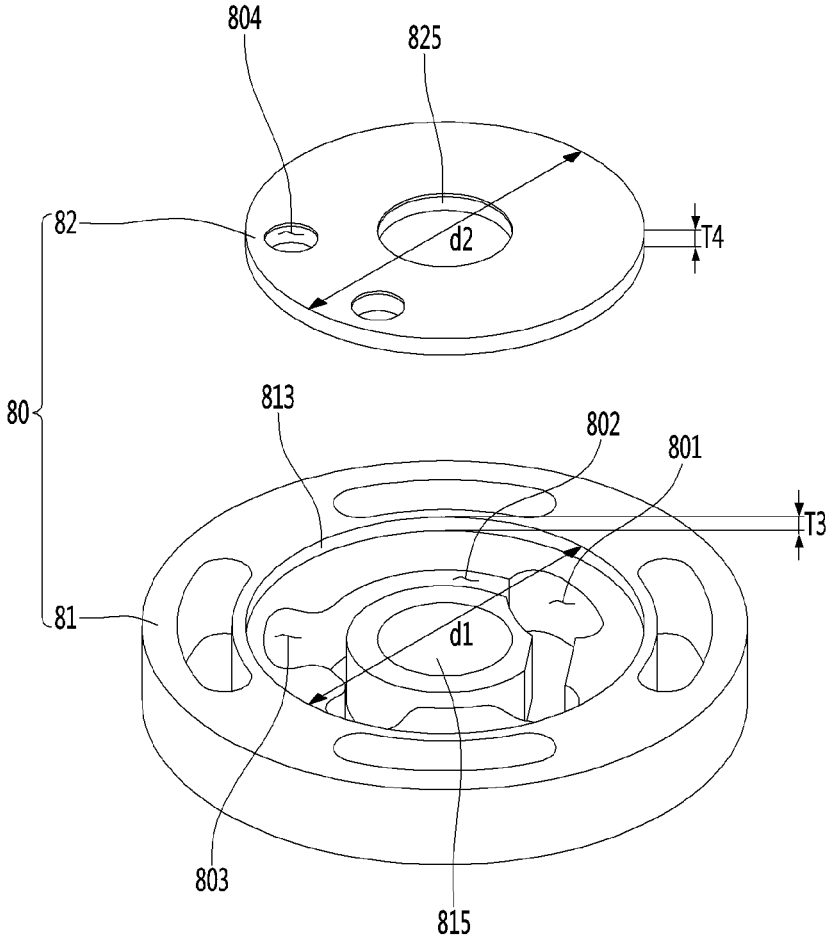
FIG. 7 is an exploded perspective view of an intermediate plate according to a third embodiment of the present invention.

FIG. 7 is an exploded perspective view of an intermediate plate according to a third embodiment of the present invention.

Referring to FIG. 7, an intermediate plate 80 according to the third embodiment of the present invention may include an intermediate plate body 81 and an intermediate plate cover 82 inserted and fixed in the intermediate plate body 81. An insertion groove 813 in which the intermediate plate cover 82 is inserted may be formed at the intermediate plate body 81. The intermediate plate 80 can be formed by inserting the intermediate plate cover 82 in the insertion groove 813 of the intermediate plate body 81.

In the embodiment, the intermediate plate body 81 can be understood as the 'second intermediate plate' of the first embodiment and the intermediate plate cover 82 can be understood as the 'first intermediate plate' of the first embodiment.

The insertion groove 813 may be formed by recessing a portion of the intermediate plate body 81 downward on the top of the intermediate plate body 81. In the embodiment, the insertion groove 813 has a first diameter d1 and a third thickness T3 and a portion of the intermediate plate body 81 can be recessed.

The intermediate plate body 81 may have a first opening 801, a second opening 803, and a connection opening 802 connecting the first opening 801 and the second opening 803 to each other. The first opening 801, second opening 803, and connection opening 802 may be further recessed downward from the insertion groove 813. The first opening 801, second opening 803, and connection opening 802 may be positioned inside the insertion groove 813 having the first diameter d1. That is, the insertion groove 813 may be stepped from the intermediate plate body 81. The first opening 801, second opening 803, and connection opening 802 may be stepped from the insertion groove 813.

The intermediate plate body 81 may have a lower refrigerant port (not shown) that communicates with the first opening 801 to allow a refrigerant to flow into the first opening 801 and a lower exhaust valve (not shown) opening/closing the lower refrigerant port (not shown). A first rotary shaft hole 815 through which a rotary shaft can be disposed may be formed in the intermediate plate body 81.

The intermediate plate cover 82 may have a second diameter d2 and a fourth thickness T4 to be able to be inserted in the insertion groove 813 of the intermediate plate body 81. The second diameter d2 of the intermediate plate cover 82 may correspond to the first diameter d1 of the intermediate plate body 81. The fourth thickness T5 of the intermediate plate cover 82 may correspond to the third thickness T3 of the intermediate plate body 81.

The intermediate plate cover 82 may have a third opening 804. The third opening 804 may be formed through the intermediate plate cover 82. The third opening 804 may be understood as a passage through which a refrigerant that has passed through the first opening 801, the second opening 803, and the connection opening 802 is discharged.

A second rotary shaft hole 825 through which the rotary shaft can be disposed may be formed in the intermediate plate cover 82. When the intermediate plate cover 82 and the intermediate plate body 81 are combined with each other, the first rotary shaft hole 801 and the second rotary shaft hole 803 can communicate with each other. Further, when the intermediate plate cover 82 and the intermediate plate body 81 are combined with each other, the first rotary shaft hole 815 and the second rotary shaft hole 825 can be separated from the first opening 801, the second opening 803, and the connection opening 802.

That is, the refrigerant compressed in the lower cylinder can flow into the first opening 801 of the intermediate plate 80 through the lower exhaust port (not shown). The refrigerant flowing in the first opening 801 can flow to the upper muffler sequentially through the connection opening 802, the second opening 803, and the third opening 804 of the intermediate plate cover 82.

According to the present invention, there is the advantage that the manufacturing process of the intermediate plate body 81 and the intermediate plate cover 82 is simplified. Further, since the intermediate plate cover 82 can be fitted and fixed in the intermediate plate body 81, it is possible to prevent the intermediate plate cover 82 from easily separating from the intermediate plate body 81.

What is claimed is:

1. A rotary compressor comprising:

a shell forming an internal space;

a driving motor disposed in the internal space of the shell;

a rotary shaft connected to the driving motor;

a lower cylinder having a lower chamber for compressing a refrigerant and a lower roller disposed inside the lower chamber;

an upper cylinder disposed on an upper side of the lower cylinder and having an upper chamber for compressing the refrigerant and an upper roller disposed inside the upper chamber;

a muffler disposed on an upper side of the upper cylinder and receiving the refrigerant compressed in the upper chamber;

a bearing disposed between the upper cylinder and the muffler and configured to guide rotation of the rotary shaft, wherein the bearing includes an upper exhaust port configured to direct flow of the refrigerant compressed in the upper chamber into the muffler; and an intermediate plate disposed between the upper cylinder and the lower cylinder and having a rotary shaft hole through which the rotary shaft is disposed, wherein the intermediate plate includes:

a lower exhaust port for discharge of the refrigerant compressed in the lower chamber, and an opening formed around the rotary shaft hole and configured to guide at least some of the refrigerant discharged from the lower exhaust port to the muffler after flowing in a radial direction of the intermediate plate, wherein the bearing further includes an opening configured to guide the refrigerant that has passed through the opening in the intermediate plate into the muffler, and wherein a flow direction of the refrigerant discharged from the upper exhaust port and a flow direction of the refrigerant discharged from the lower exhaust port are the same.

2. The rotary compressor of claim 1, wherein the opening of the intermediate plate includes:

a first opening configured to receive the refrigerant discharged from the lower exhaust port;

a second opening spaced apart from the first opening;

a connection opening connecting the first opening and the second opening to each other; and a third opening connected to the second opening and configured to discharge the refrigerant passing through the second opening.

3. The rotary compressor of claim 2, wherein the intermediate plate includes:

a first intermediate plate covering a bottom of the upper chamber; and a second intermediate plate covering a top of the lower chamber and being in contact with the first intermediate plate.

4. The rotary compressor of claim 3, wherein the third opening is defined in the first intermediate plate, and the first, second, and connection openings are at least partially defined in the second intermediate plate.

5. The rotary compressor of claim 4, wherein the first, second, and connection openings are at least partially defined by recesses extending downward into a top of the second intermediate plate.

6. The rotary compressor of claim 5, wherein the first, second, and connection openings are also at least partially defined by recesses extending upward into a bottom of the first intermediate plate.

7. The rotary compressor of claim 5, wherein a fourth opening is defined through the upper cylinder and configured to guide the refrigerant discharged from the third opening.

8. The rotary compressor of claim 7, wherein the opening in the bearing is configured to guide the refrigerant that has passed through the fourth opening to the muffler.

9. The rotary compressor of claim 4, wherein a thickness of the first intermediate plate is smaller than a thickness of the second intermediate plate.

10. The rotary compressor of claim 9, wherein an insertion groove in which the first intermediate plate is inserted is formed by recessing downward at least a portion of the second intermediate plate.

11. A rotary compressor of claim 10, wherein the first opening, the second opening, and the connection opening are recessed downward further from the insertion groove.

12. The rotary compressor of claim 4, wherein the connection opening is recessed radially from the shaft hole, and the first and second openings are recessed radially further from the connection opening.

13. The rotary compressor of claim 1, wherein a plurality of suction pipes are connected to the shell, and the suction pipes include:

a first suction pipe for supplying a refrigerant to be compressed in the upper chamber; and a second suction pipe for supplying a refrigerant to be compressed in the lower chamber.

14. A rotary compressor comprising:

a shell forming an internal space;

a driving motor disposed inside the internal space of the shell;

a rotary shaft connected to the driving motor;

an upper cylinder having an upper chamber for compressing a refrigerant and an upper roller disposed inside the upper chamber;

a bearing disposed on an upper side of the upper cylinder and having a hole through which the rotary shaft is disposed, wherein the bearing includes an upper exhaust port configured to supply the refrigerant compressed in the upper chamber into a muffler;

the muffler covering a top of the bearing and reducing noise that is generated when a refrigerant is discharged to the internal space;

a lower cylinder disposed on a lower side of the upper cylinder and having a lower chamber for compressing a refrigerant and a lower roller disposed inside the lower chamber; and an intermediate plate disposed between the upper cylinder and the lower cylinder and having a rotary shaft hole through which the rotary shaft is disposed, wherein the intermediate plate includes a lower exhaust port configured to supply the refrigerant compressed in the lower chamber into an opening defined within the intermediate plate, wherein the intermediate plate includes an opening formed around the rotary shaft hole and configured to guide at least some of a refrigerant discharged from the lower exhaust port to the muffler after flowing in a radial direction of the intermediate plate, and wherein the bearing further includes an opening contiguous with the upper exhaust port and configured to guide the refrigerant that has passed through the opening of the intermediate plate to flow into the muffler, and wherein a discharge direction of the refrigerant discharged from the lower exhaust port and a discharge direction of the refrigerant discharged from the upper exhaust port are the same.

15. The rotary compressor of claim 14, wherein the refrigerant compressed in the lower chamber passes through the opening of the intermediate plate and then reaches the muffler after passing through the upper cylinder and the bearing.

16. The rotary compressor of claim 14, wherein the intermediate plate includes:

a first intermediate plate covering a bottom of the upper chamber; and a second intermediate plate covering a top of the lower chamber and being in contact with the first intermediate plate, and the opening includes:

a first opening formed at the first intermediate plate;

a second opening formed at the second intermediate plate; and a connection opening connecting the first opening and the second opening and formed between the first intermediate plate and the second intermediate plate.

* * * * *